US009196114B2

(12) United States Patent
Kiely et al.

(10) Patent No.: US 9,196,114 B2
(45) Date of Patent: Nov. 24, 2015

(54) ENHANCED GAMING DISPLAY THROUGH PERSONAL GAMING DEVICE

(71) Applicant: IGT, Las Vegas, NV (US)

(72) Inventors: Daryn G. Kiely, Henderson, NV (US); Dwayne R. Nelson, Las Vegas, NV (US); Derek P. McIntyre, Reno, NV (US); Michael B. Gardner, Reno, NV (US); Xuedong Chen, Reno, NV (US)

(73) Assignee: IGT, Las Vegas, NV (US)

( * ) Notice: Subject to any disclaimer, the term of this patent is extended or adjusted under 35 U.S.C. 154(b) by 143 days.

(21) Appl. No.: 14/012,390

(22) Filed: Aug. 28, 2013

(65) Prior Publication Data

US 2015/0065219 A1 Mar. 5, 2015

(51) Int. Cl.
*G07F 17/32* (2006.01)
*G07F 17/34* (2006.01)

(52) U.S. Cl.
CPC ..... *G07F 17/3211* (2013.01); *G07F 17/3293* (2013.01); *G07F 17/34* (2013.01)

(58) Field of Classification Search
CPC ..... G07F 17/3211; G07F 17/3209; G07F 17/3204
See application file for complete search history.

(56) References Cited

U.S. PATENT DOCUMENTS

| | | | | |
|---|---|---|---|---|
| 2010/0234099 | A1* | 9/2010 | Rasmussen et al. | 463/29 |
| 2012/0184352 | A1* | 7/2012 | Detlefsen et al. | 463/25 |
| 2013/0122995 | A1* | 5/2013 | Detlefsen et al. | 463/25 |
| 2013/0260882 | A1* | 10/2013 | Hamlin et al. | 463/31 |
| 2013/0337878 | A1* | 12/2013 | Shepherd et al. | 463/11 |

* cited by examiner

*Primary Examiner* — Jay Liddle
*Assistant Examiner* — Alex F. R. P. Rada, II
(74) *Attorney, Agent, or Firm* — Neal, Gerber & Eisenberg LLP

(57) ABSTRACT

Gaming machines and methods for transmitting hidden elements to a portable electronic device are described. The gaming machine includes a cabinet, a display, and a user input mechanism. The gaming machine further includes an interface, wherein the interface is configured to wirelessly communicate with a portable electronic device. The gaming machine includes a game controller. The game controller is configured to provide game play of a wager-based game, including generating gaming information including a hidden element. The game controller is further configured to display at least a portion of the gaming information to the player through the display, wherein the hidden element is not displayed. The game controller is configured to facilitate a data connection between the gaming machine and the portable electronic device through the interface. The game controller is further configured to transmit the hidden element to the portable electronic device.

18 Claims, 6 Drawing Sheets

ENHANCED GAMING DISPLAY THROUGH PERSONAL GAMING DEVICE

BACKGROUND

Casino patrons often carry portable electronic devices while visiting the casino. For example, many patrons carry smartphones (e.g., iPhones™, Android™ devices, Blackberry™ devices, Windows™ devices), tablets (e.g., iPads™, Android™ Nexus™ tablets, etc.), PDAs, portable media players (e.g., iPods™, Zunes™, etc.), laptops, and other portable electronic devices. Often, these devices have access to networks and the Internet through wireless connections. Casino patrons use the portable electronic devices to contact other people, check e-mails, surf the Internet, play games, browse social mediasites, and so on.

In order to allow a personal portable electronic device to interface with the gaming systems of a casino, the casino may allow the patron to download an application onto the portable electronic device prior to allowing the device to access the casino's gaming system. The application may allow the player to access the gaming network and allow the gaming system to communicate information to the player via the portable electronic device.

SUMMARY

One embodiment of the invention relates to a gaming machine. The gaming machine includes a cabinet, a display coupled to the cabinet, and a user input mechanism coupled to the cabinet. The gaming machine further includes an interface coupled to the cabinet, wherein the interface is configured to wirelessly communicate with a portable electronic device controlled by a player of the gaming machine. The gaming machine includes a game controller coupled to the cabinet. The game controller is configured to provide game play of a wager-based game to the player, including generating gaming information including a hidden element. The game controller is further configured to display at least a portion of the gaming information to the player through the display, wherein the hidden element is not displayed such that the player cannot view the hidden element. The game controller is configured to facilitate a data connection between the gaming machine and the portable electronic device through the interface. The game controller is further configured to transmit the hidden element to the portable electronic device.

Another embodiment of the invention relates to a method in a gaming system including a gaming machine. The method includes providing game play of a wager-based game on the gaming machine, including generating gaming information including a hidden element. The method further includes displaying at least a portion of the gaming information to the player through a display of the gaming machine, wherein the hidden element is not displayed such that a player of the gaming machine cannot view a hidden element on the display. The method includes facilitating a data connection between the gaming system and the portable electronic device through the interface. The method further includes providing game data to the portable electronic device, including the hidden element.

Yet another embodiment of the invention relates to a non-transitory computer readable media with computer-executable instructions embodied thereon that, when executed by a processor, causes the processor to perform a method. The instructions cause the processor to provide game play of a wager-based game on a gaming machine, including generating gaming information including a hidden element. The instructions cause the processor to display at least a portion of the gaming information to the player through a display of the gaming machine, wherein the hidden element is not displayed such that the player of the gaming machine cannot view the hidden element through the display. The instructions cause the processor to facilitate a data connection between the gaming system and a portable electronic device through the interface. The instructions cause the processor to includes provide game data to the portable electronic device, including the hidden element.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

Gaming systems and methods that encourage a player's use of the player's personal portable electronic devices are described. The gaming systems can include a number of features that encourage and enable the use of the portable electronic devices, such as smart phones, tablet computers, PDAs, portable media players, digital cameras, laptop computers, and the like in a casino gaming environment. In particular embodiments, electronic gaming machines and/or gaming servers used in the gaming system include interfaces for sending and receiving communications with portable electronic devices. A portable electronic device communicating within the gaming system can be used to supplement game play on a designated gaming machine by displaying additional information not displayed, hidden, or obscured on a display of the gaming machine. Still further, the gaming system may require the patron to install a casino application on the portable electronic device to be used with the gaming system.

Figure 1:
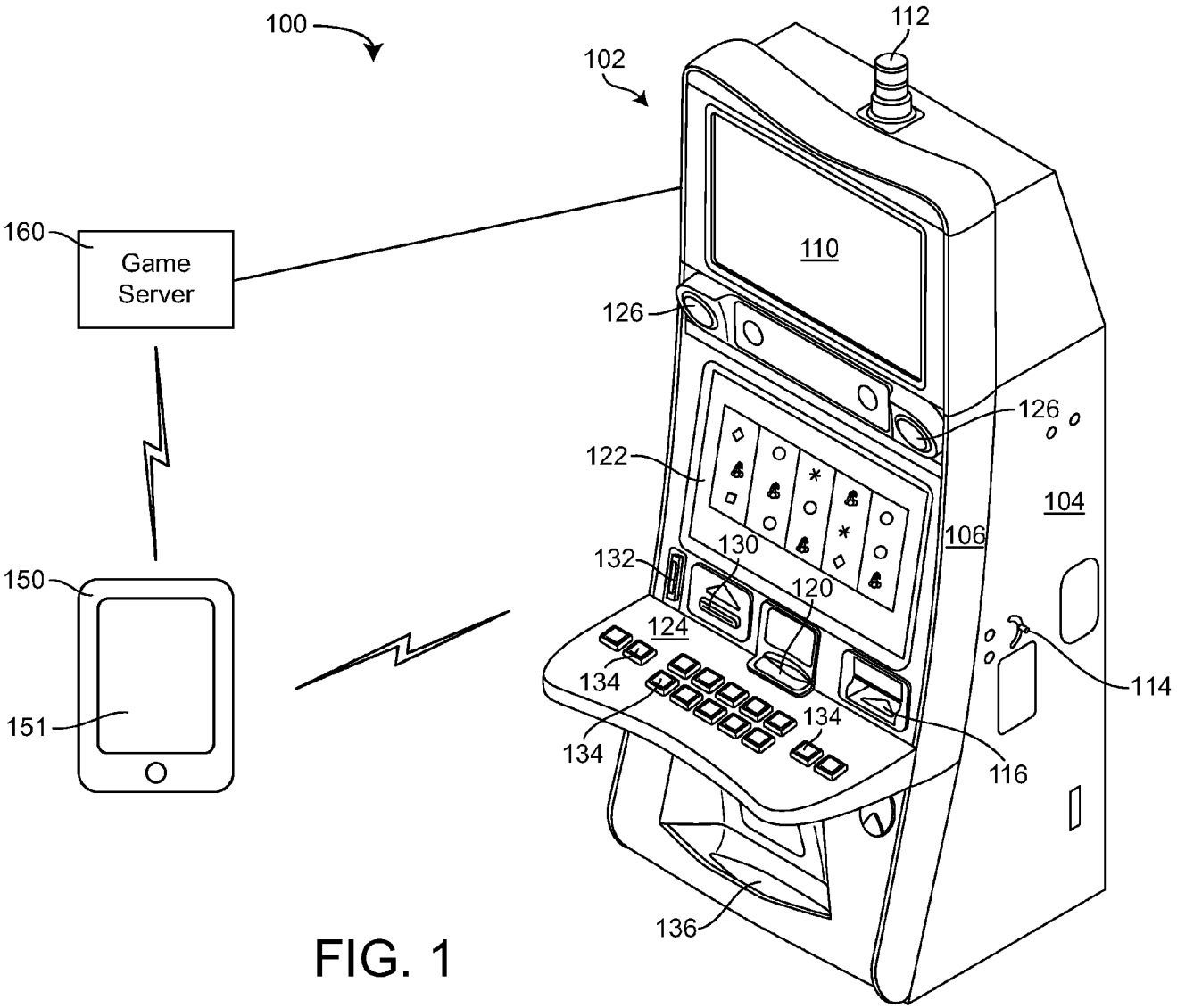
FIG. 1 is a perspective view of a gaming system according to an exemplary embodiment.

Referring to FIG. 1, gaming system 100 is shown according to an exemplary embodiment. Gaming system 100 includes gaming machine 102 and mobile device 150. Gaming system 100 optionally includes game server 160. Gaming machine 102 includes main cabinet 104. Main cabinet 104 provides a secure enclosure that prevents tampering with device components, such as a game controller (not shown) located within the interior of main cabinet 104. Main cabinet 104 includes an access mechanism, such as door 106, which allows the interior of gaming machine 102 to be accessed. Actuation of door 106 may be controlled by locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 includes any number of user interface devices that convey sensory information to a user and/or receive input from the user. For example, gaming machine 102 may include a first electronic display 110, a second electronic display 122, speakers 126, and/or a candle device 112 to convey information to the user of gaming machine 102. Gaming machine 102 includes console 124 having one or more inputs 134 (e.g., buttons, track pads, etc.) configured to receive input from a user. A controller (not shown) within gaming machine 102 may run a game, such as a wager-based game, in response to receiving input from a user via inputs 134 or displays 110, 122. For example, inputs 134 may be operated to place a wager in the game and to run the game. In response, the controller may cause reels shown on display 122 to spin, such as with a slot game, and/or display 110 to display the results of the game.

Gaming machine 102 may also include devices for conducting a wager-based game. For example, gaming machine 102 may include ticket acceptor 116 and printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 includes loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, a free room upgrade, discounts, etc.).

Still referring to FIG. 1, in some embodiments, gaming system 100 includes game server 160. Game server 160 communicates with gaming machine 102 though a gaming network. Game server 160 may be used to store gaming data generated at gaming machine 102. Game server 160 may store player account information (e.g., player loyalty account information, player financial information, etc.). Game server 160 may further be used to provide networked game play in which game server 160 executes at least a portion of the game program for display on gaming machine 102. Still further, game server 160 may facilitate multiplayer gaming between multiple gaming machines within the casino.

Gaming system 100 is configured to communicate with portable electronic device 150. Portable electronic device 150 may be a smart phone, a tablet computer, a PDA, a portable media player, a digital camera, a laptop computer, or the like. Portable electronic device 150 can communicate directly with gaming machine 102 through a wireless network interface (e.g., 802.11, Bluetooth™, Zigbee™, infrared, etc.) or a wired interface (e.g., gaming machine 102 may include a wired connector such as an Ethernet or USB™ connector). Alternatively or additionally, portable electronic device 150 communicates with server 160 through a wireless network interface (e.g., 802.11, Bluetooth™, Zigbee™, infrared, etc.). In order to interface with gaming machine 102 and/or gaming server 160, gaming system 100 may require that portable electronic device 150 be executing a gaming system application (e.g., a smartphone application for the casino where gaming system 100 is installed).

The gaming system application may be offered through an online application store or download host accessible through the Internet. Alternatively, the gaming system application may be offered for download through a local area network in the casino. The gaming system application enables portable electronic device 150 to communicate with gaming system 100 equipment, including gaming machine 102 and/or gaming server 160. The gaming system application may provide a portal to the player to manage casino related accounts (e.g., the player's loyalty account, the player's credit accounts, etc.), view casino information (e.g., casino special events and advertising), enable portable electronic device 150 to function as a player loyalty card, and/or allow portable electronic device 150 to function as a cashless gaming instrument. As described in further detail below, the gaming system application allows a player of gaming machine 102 to use portable electronic device 150 to supplement or enhance game play on gaming machine 102. For example, during game play on gaming machine 102, additional game information may be displayed on display 151 of portable electronic device 150.

Figure 2:
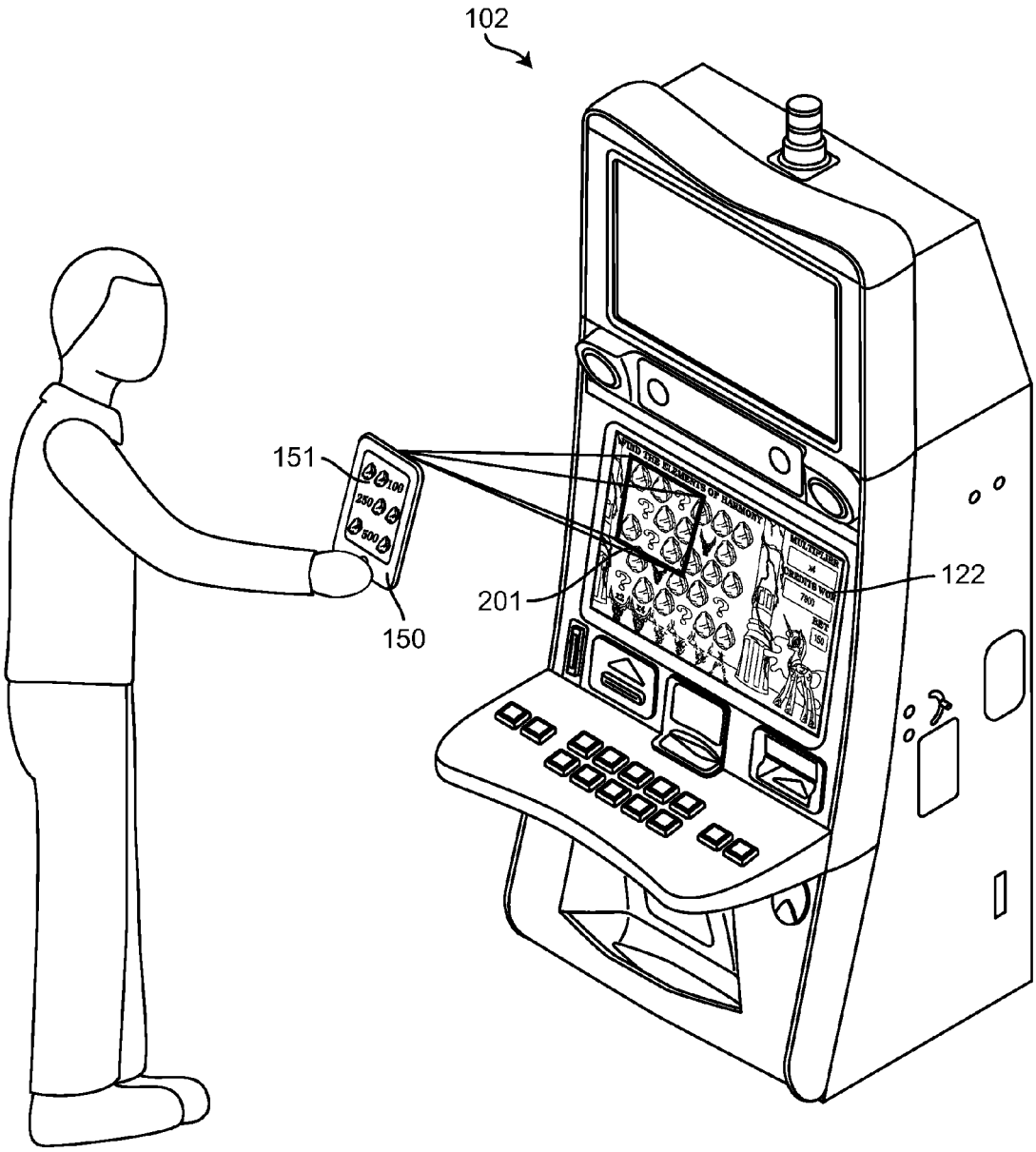
FIG. 2 is a view of a player using a portable electronic device to reveal hidden information on a gaming machine according to an exemplary embodiment.

Referring to FIG. 2, an arrangement of a player using portable electronic device 150 with gaming machine 102 is shown according to an exemplary embodiment. During game play on gaming machine 102, game information is presented to the player through display 122. Depending on the game and configuration, gaming machine 102 is configured to present hidden elements that serve to hide portions of the game information and/or non-gaming information such that the player cannot view the hidden elements and/or the content of the hidden elements by directly viewing display 122. The play may be alerted to the presence of a hidden elements through display 122 by a graphic indicator (as discussed in further detail below with respect to FIG. 3 through FIG. 5). For example, a player of a game may recognize that a hidden element exists by identifying a certain symbol or graphic (e.g., a question mark), but the player is prevented from viewing the hidden element through the display of the gaming machine. In such an arrangement, the player may be able to view the hidden element through display 151 on connected portable electronic device 150. In other arrangements, the player may be completely unaware of the presence of a hidden element during game play without the use of portable electronic device 150. For example, during a game of poker, gaming machine 102 may present a normal 5-card version of poker to players without a connected portable electronic device. When a user connects portable electronic device 150 to gaming machine 102, the player may be able to play a 7-card version of poker, wherein the two additional cards are normally hidden from view on display 122, but visible on display 151. If gaming system 100 determines that portable electronic device 150 is connected, gaming machine 102 may prompt the player to view the hidden element on portable electronic device 150. If gaming machine 102 determines that portable electronic device 150 is not connected, gaming machine 102 may prompt the user to connect portable electronic device 150 so that the player can view the hidden element. The prompt may be an audio and/or visual notification sent to the user (e.g., displaying "please connect your phone to view additional game information").

In some embodiments, the content of the hidden element may relate to gaming information or non-gaming information. The hidden gaming information is used during game play of the gaming machine. Hidden gaming information may be necessary for the player to play the game. For example, the hidden gaming information may relate to a card's value and suit in a video poker game. In alternative arrangements, the hidden gaming information may not be needed by the player to play the game. For example, the hidden gaming information may relate to a tip or an irrelevant symbol that doesn't affect the odds of the game. In the case of unnecessary hidden gaming information, the revealing of the hidden gaming information may provide the false impression that the player is gaining an advantage in the game, when knowledge of the hidden information does not affect the player's chances of winning the game. The hidden information may relate to hints, tips, or rules for playing the game. Hidden non-gaming information may also relate to casino comps, casino specials and events, and advertisements.

To view the hidden element with portable electronic device 150, the player may need to obtain an eligible gaming status prior to having the ability to see the content of the hidden element. For example, the player may need to pay a fee to see the hidden element. As an additional example, the player may earn a certain number of reveals through play of the game. Still further, a player may have a set number of reveals available based on the player's status in a casino's player loyalty program. For example, a gold member may have a first number of reveals available per game cycle while a silver member may have a second number of reveals available per game cycle, wherein the second number is less than the first number. Setting the number of reveals based on loyalty program tiers can be expanded into any number of tiers.

In some arrangements, portable electronic device 150 includes a camera. Accordingly, when gaming machine 102 presents hidden elements through display 122, the player can direct the camera of portable electronic device 150 at display 122. The camera captures area 201 of display 122 and reproduces area 201 on display 151. Gaming machine 102 (or server 160) transmits the content of the hidden elements on display 122 in area 201 to portable electronic device 150. The system application being executed on portable electronic device 150 processes the received hidden gaming information along with the captured images from the camera and overlays the content of the hidden elements on display 151 such that the content of the hidden elements is revealed to the player. The camera of gaming machine 102 may be configured to capture video data of display 122 for presentation on display 151. Accordingly, the player can move or aim portable electronic device 150 at different areas of display 122, and portable electronic device 150 dynamically updates the displayed gaming data to reveal the content of the hidden elements as the player moves portable electronic device 150 to target different areas of display 122. In the dynamically updating arrangement, portable electronic device 150 functions as a type of augmented reality device.

In an alternative configuration, the player can capture a static image of display 122 through a camera of portable electronic device 150. Portable electronic device 150 then processes the image and the receives hidden gaming information data, which is used by portable electronic device 150 to create a modified image of display 122 that reveals the content of the hidden elements.

In yet another configuration, portable electronic device 150 displays game information on display 151 without the use of a camera. In such an arrangement, gaming machine 102 (or server 160) transmits gaming information, including the content of any hidden elements, to portable electronic device 150. The transmitted gaming information may be an already processed image or video file delivered to portable electronic device 150 for presentation to the player through display 151. Alternatively, the transmitted gaming information is not an already processed image or video file, but rather a gaming information that is processed by portable electronic device 150 to render the displayed image on display 122 (or a similar image) that includes the identity of the hidden gaming information. The gaming information may be provided to portable electronic device 150 as a data stream such that the information presented to the player through display 151 is regularly updated as game play progresses on gaming machine 102. The gaming information presented to the player through display 151 may include a graphic, an animation, and/or textual information. The information presented to the player through display 151 includes the content of at least a portion of the hidden elements displayed on display 122. The information presented to the player through display 151 may be a mirror image of the information presented to the player on display 122, with the exception of the inclusion of the identity of at least a portion of the hidden information.

Figure 3:
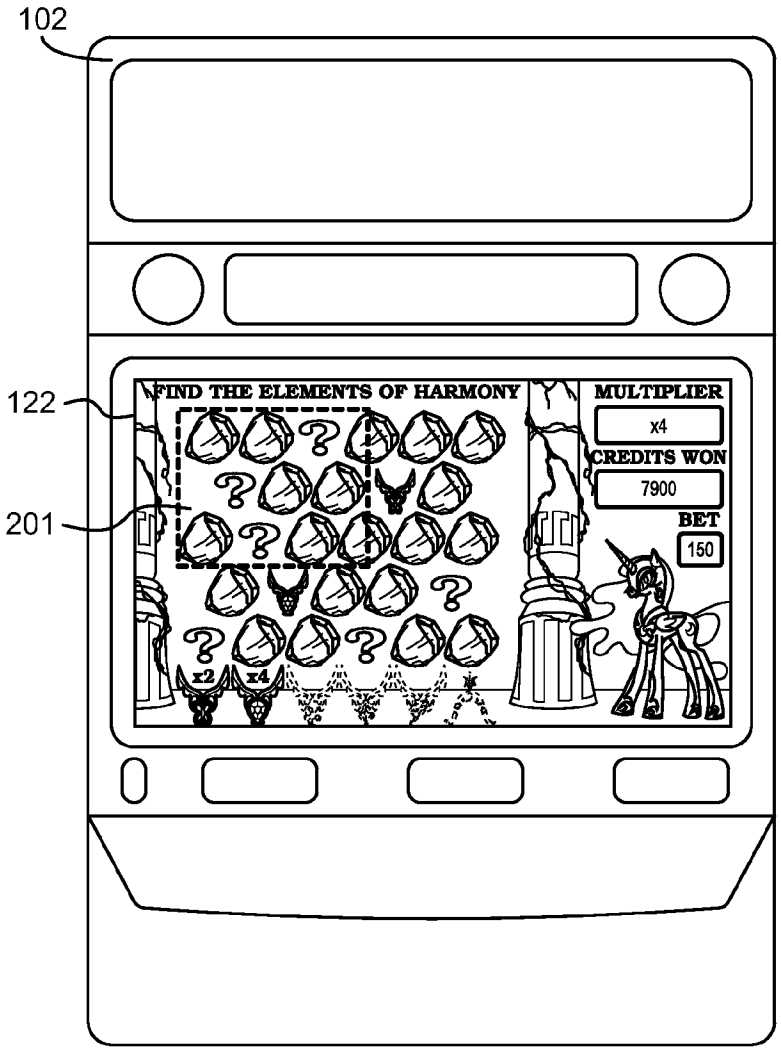
FIG. 3 is a view of a portable electronic device display and a gaming machine display according to an exemplary embodiment.
Figure 3:
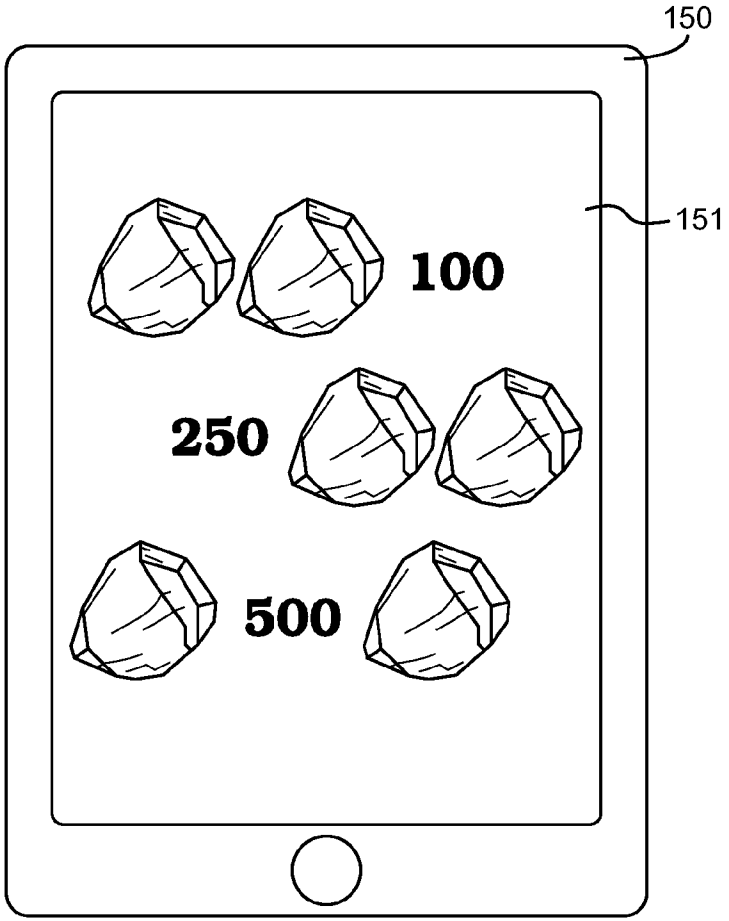

Referring to FIG. 3, a view of portable electronic device 150 and gaming machine display 122 are shown according to the embodiment of FIG. 2. Gaming machine 102 is shown during game play of a game. Display 122 displays graphics and animations to the player of the game. Display 122 outputs a plurality of gaming symbols 301. Gaming symbols 301 inform the player of information used to make decisions during the game. Display 122 outputs at least one hidden element 302. Hidden element 302 represents an unknown to the player of the game. Hidden element 302 is represented by a graphic, shown in FIG. 3 as a question mark. The identity of the gaming content concealed by hidden element 302 may be revealed to the player of the game through portable electronic device 150. As discussed above with respect to FIG. 2, portable electronic device 150 may be paired with gaming machine 102 (or server 160) and may be used as a decoder that enables the player to learn the identity of hidden elements 302. In this particular arrangement, display 151 displays area 201 of gaming content displayed on display 122. However, it should be understood that display 151 may be configured to mirror the entire contents of display 122.

Figure 4:
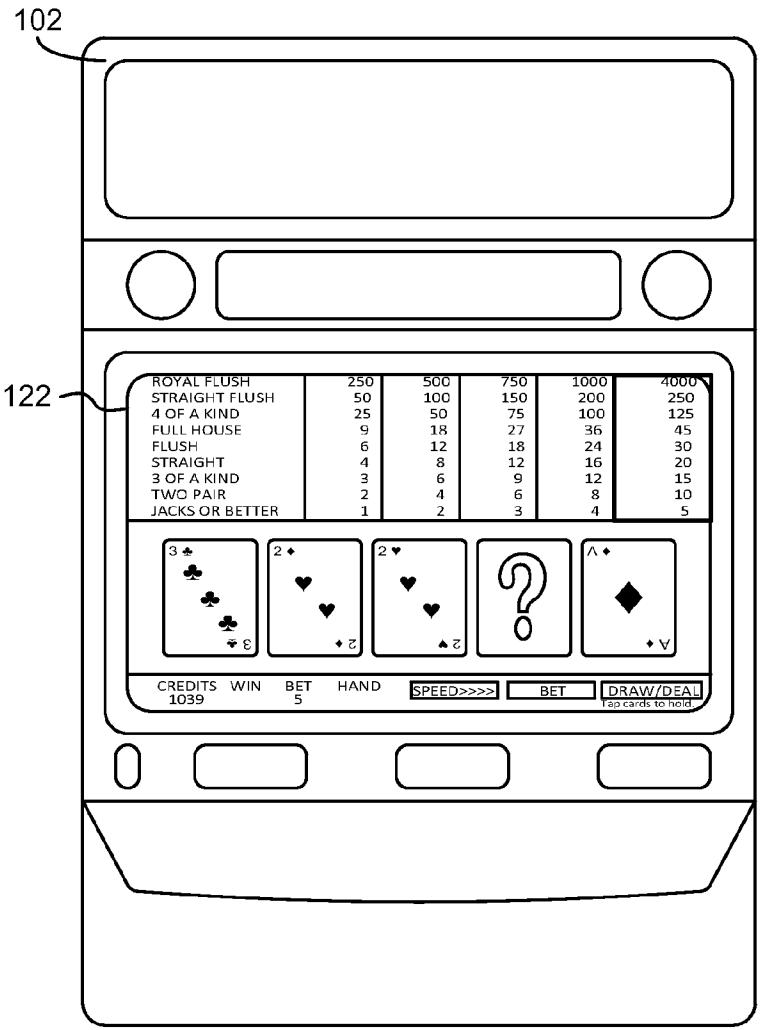
FIG. 4 is a view of a portable electronic device display and a gaming machine display according to an exemplary embodiment.
Figure 4:
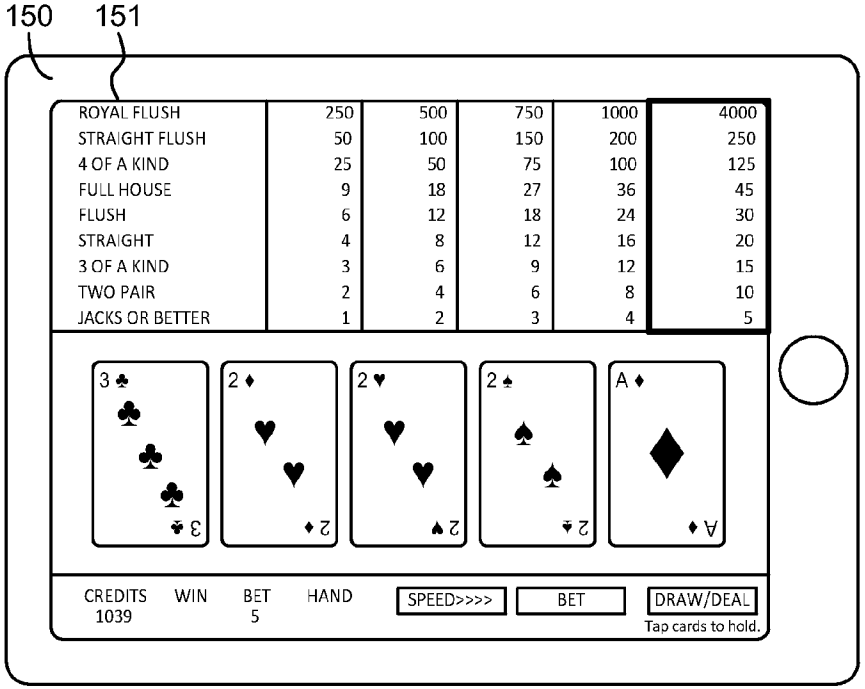

Referring to FIG. 4, a view of portable electronic device 150 and gaming machine display 122 are shown according to another exemplary embodiment. In the present embodiment, gaming machine 102 is presenting the player a poker game through display 122. The poker game as shown through display 122 shows five cards, however, one of the cards is presented as hidden card 401. The value of hidden card 401 is not shown to the player through display 122. To view the value of hidden card 401, the player needs to reference screen 151 of portable electronic device 150. Display 151 generally displays the same gaming information as displayed by display 122, however, display 151 displays the identity of hidden card 401.

Figure 5:
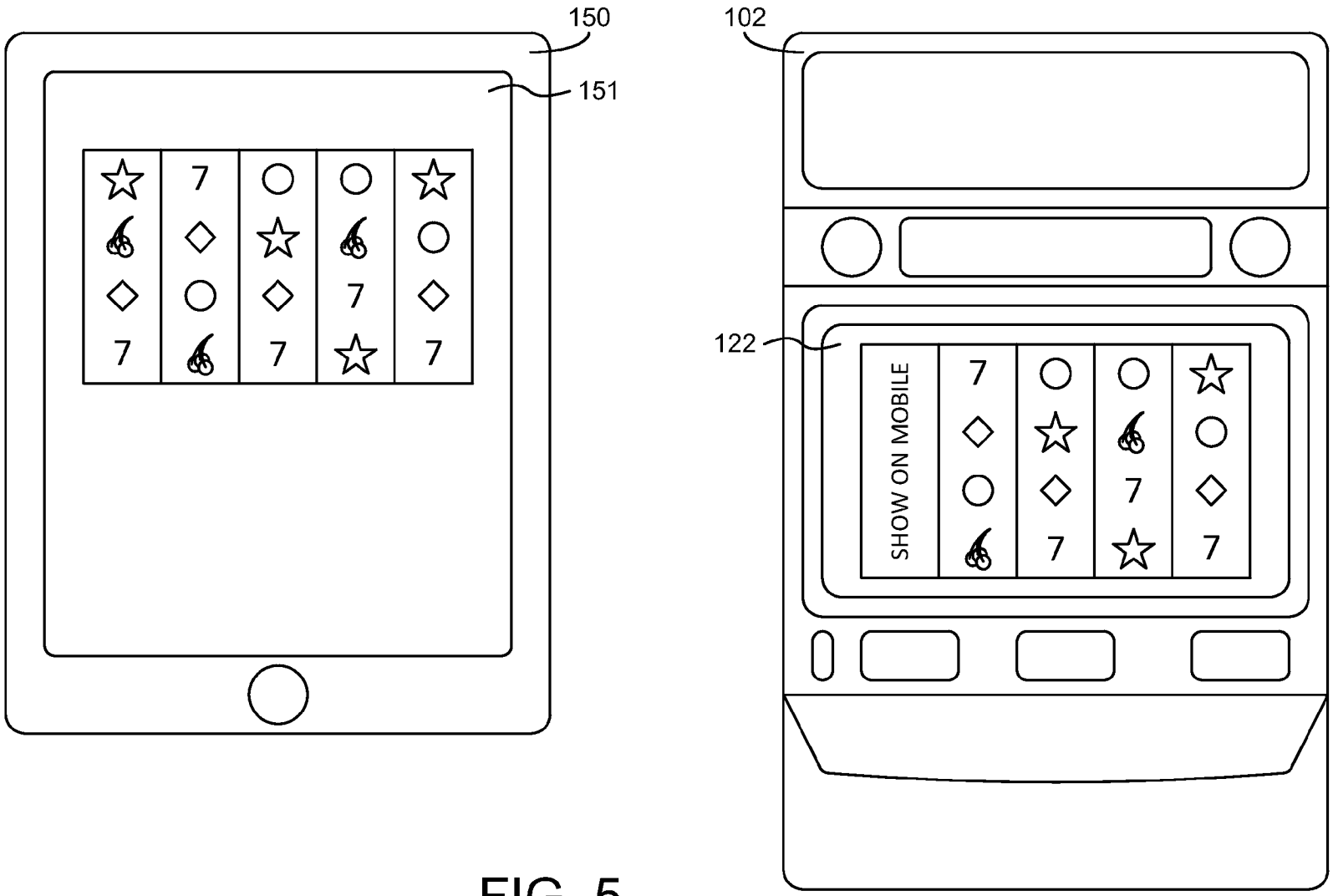
FIG. 5 is a view of a portable electronic device display and a gaming machine display according to an exemplary embodiment.

Referring to FIG. 5, a view of portable electronic device 150 and gaming machine display 122 are shown according to another exemplary embodiment. In the present embodiment, gaming machine 102 is presenting the player a video slot game through display 122. The video slot game includes five video reels 501-505. Four of the video reels, video reels 502-505, are visible to the player through display 122. Video reel 501 is presented to the player as a hidden video reel having its contents hidden from the player on display 122. The contents of hidden video reel 501 may be viewed by the player through display 151 of portable electronic device 150. In some embodiments, hidden video reel 501 is optional in that the player does not need to view hidden reel 501 to play the video slot game (i.e., the user may play the slot game without playing the bonus reel). In this arrangement, hidden reel 501 may be a bonus reel or a multiplier reel and is available to the player for an extra bet.

Accordingly, prior to spinning the video reels of the slot game, the player may be presented for the option to play hidden reel 501. The option to play hidden reel 501 may cost the player more money, may be earned as part of the game, or may be earned as part of a player loyalty program. In order to do so, the player must connect a portable electronic device (e.g., portable electronic device 150) to gaming machine 102 (or to server 160). During game play, video reels 502-505 spin on display 122 and hidden video reel 501 spins on display 151. In some embodiments, display 151 is configured to display all video reels 501-505 spinning during game play. Mobile device 150 is purely used to display the video reels 501-505 and the outcome of the game. Mobile device 150 does not perform necessary random number generation or pay table calculations. Gaming machine 102 (or server 160) performs all necessary random number generation and pay table calculations and transmits the necessary information to mobile device 150.

Figure 6:
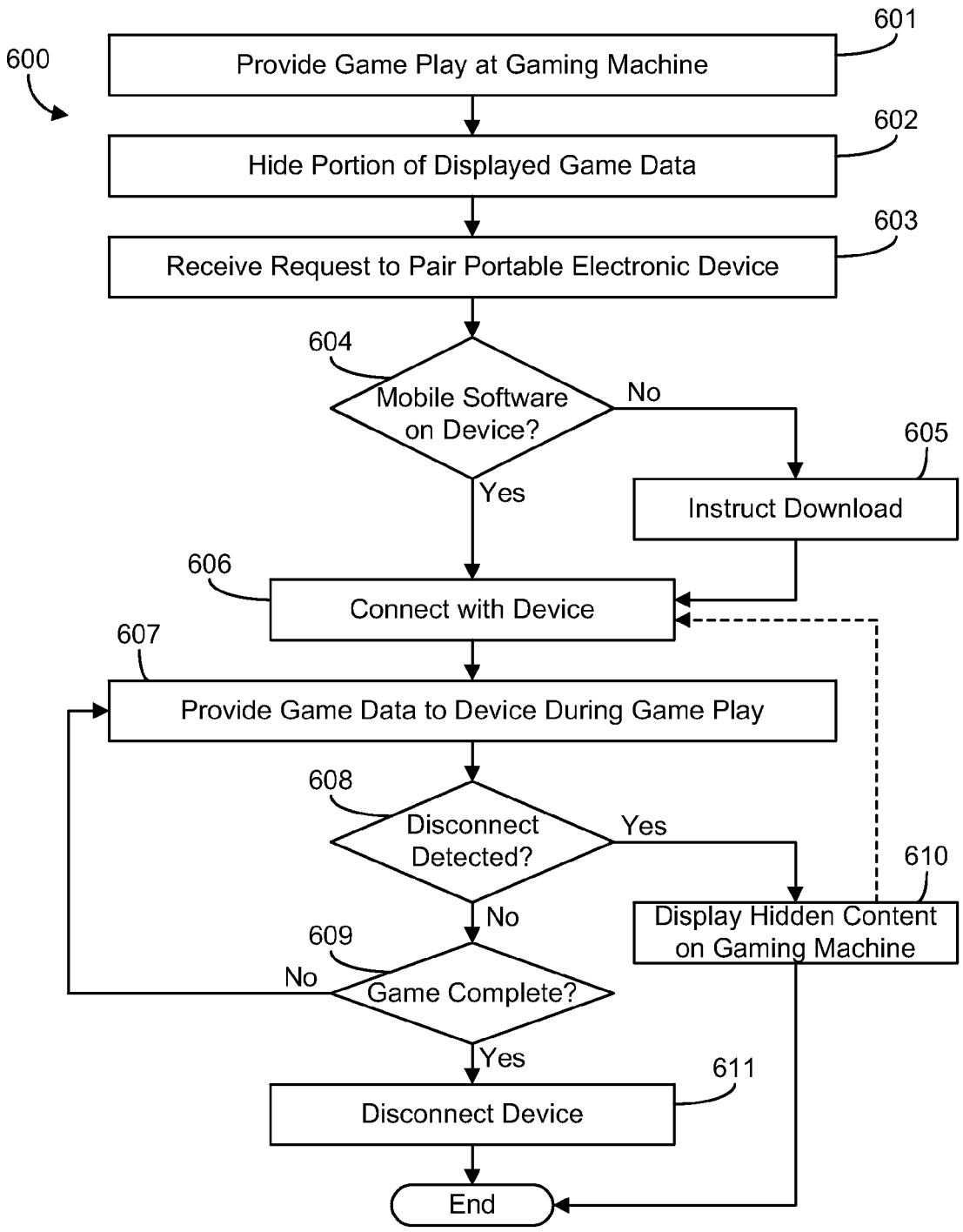
FIG. 6 is a flow diagram of a method of providing game play on a gaming machine according to an exemplary embodiment.

Referring to FIG. 6, a flow diagram of a method 600 within a gaming system including gaming machine (e.g., gaming machine 102) and optionally including gaming server (e.g., server 160) is shown according to an exemplary embodiment. Method 600 generally relates to connecting a portable electronic device (e.g., portable electronic device 150) to the gaming system to reveal additional gaming information to a player of the gaming system.

A gaming machine is configured to provide game play to a player (step 601). The gaming machine may execute the game code locally, in which case the remaining steps are performed by the gaming machine. Alternatively, the gaming machine may function as a thin client having at least a portion of the gaming code executed remotely on a gaming server, in which case the remaining steps are performed by the gaming machine, the gaming server, or a combination of both. The game code relates to a game offered for play to a player. The game may be a wager-based game. The game may include a hidden element feature. As discussed above, a hidden element feature prevents the player of a game from viewing at least a portion of the gaming content or casino content on the main display of the gaming machine (e.g., display 122 of gaming machine 102). The hidden element may relate to information used during the game (e.g., the value and suit of a card, a gaming symbol, a symbol on a gaming reel, a gaming reel, etc.). Alternatively, the hidden element may relate to non-gaming information such as loyalty points, advertisements, casino comps, etc.

After a player begins game play at the gaming machine, the gaming system hides a portion of the game data from being viewed on the main display of the gaming machine (step 602). As described above, the content of the hidden element is hidden from view by overlaying an image or animation over the location where the gaming information is displayed (e.g., as shown in FIG. 3, FIG. 4, and FIG. 5). The gaming machine then displays a message to the player of the gaming machine indicating that the hidden elements may be revealed through the pairing of a portable electronic device (e.g., portable electronic device 150). In some arrangements, the message may indicate that the portable electronic device may be paired with the gaming system for a fee or only if a certain player loyalty level (e.g., silver, gold, platinum, etc.) has been achieved by the player.

The gaming machine receives a request to pair a portable electronic device to the gaming system (e.g., to the gaming machine or to the gaming server) from the player (step 603). The request may be received through an input of the gaming machine (e.g., the player presses a button to pair a portable electronic device with the gaming system). Alternatively, the request is received through the portable electronic device through a network connection between the device and the gaming system. After receipt of the request, the gaming system determines whether the portable electronic device has the appropriate application installed necessary to enable the portable electronic device to interface with the gaming system (step 604). If the gaming system determines that the portable electronic device does not have the application installed, the gaming system instructs the player to download the application on the portable electronic device (step 605). In an exemplary embodiment, the gaming system may display a message on the display of the gaming machine. The message directs the player to a download location of the application (e.g., an application store accessible through the internet, a website containing an installation file for the application, a shared folder on a local network accessible by the portable electronic device, etc.). The displayed message may include machine readable code such as a barcode or a two-dimensional barcode (e.g., a QR Code™) that is scannable by a camera of the portable electronic device. After the portable electronic device scans the code, the portable electronic device is directed to a download location for the application.

After the gaming system verifies that the portable electronic device has the application installed, the gaming system connects with the portable electronic device (step 606). The connection is made through a wired connection (e.g., USB™, Ethernet, etc.) or a wireless connection (e.g., 802.11, Bluetooth™, Zigbee™, infrared, etc.). In some configurations, the portable electronic device connects directly to the gaming machine. In other configurations, the portable electronic device connects to a gaming server. In some arrangements, the portable electronic device may have been previously connected to the gaming system with limited capability (e.g., to download the application). In such an arrangement, the application provides a greater level of access to the portable electronic device to the gaming system.

The gaming system then provides gaming data to the portable electronic device during game play on the gaming system (step 607). The game data relates to the identity of the hidden elements being displayed on the gaming machine. Accordingly, the player of the game can view at least a portion of the hidden elements of the game through a display of the portable electronic device. The portable electronic device may function as an augmented reality device (as described above with respect to FIG. 2). Alternatively, the portable electronic device renders a mirror image (or a similar image) of the gaming machine display but overlays or substitutes the hidden elements with the element's content (e.g., question marks representing hidden gaming elements are replaced with gaming symbols, award values, casino comps, etc.). In some arrangements, the amount of hidden elements revealed to the player through the portable electronic device varies depending on the player's status in a loyalty program. For example, only one hidden element may be revealed to the player if the player is a bronze member, two elements if the player is a silver member, three elements if the player is a gold member, and four elements if the player is a platinum member. The number of hidden elements revealed to the player may depend on an amount of money paid to reveal hidden elements. The number of hidden elements revealed to the player may depend on trigger events during game play (e.g., elements may be revealed as part of a bonus system).

During the provision of gaming data to the portable electronic device, the gaming system monitors for an unexpected disconnection of the portable electronic device from the gaming system (step 608). If no unexpected disconnection is experienced, the gaming system monitors the game play for an indication that the game play has ended (step 609). Until game play has ended, the gaming system continues to provide game data to the portable electronic device and continues to monitor for an unexpected disconnection. If an unexpected disconnection is detected, the gaming system is configured to display the content of the hidden elements on the display of the gaming machine such that the player is still able to view the content of the hidden elements (step 610). The content is only displayed until the end of the game cycle (e.g., until the particular instance of the game is finished, until the video reels stop spinning, until the next hand of poker is dealt, etc.). The gaming machine may also display an indication to the player that the disconnection has occurred. For example, gaming machine 102 may display a message on display 122 requesting that the player reconnect the portable electronic device to the gaming system. Accordingly, method 600 may return to step 606 if the player wishes to reconnect the portable electronic device to the gaming system. If the player does not reconnect the device, the game finishes after the game cycle is complete.

The player may indicate that game play has ended when the player performs a cash-out function on the gaming machine, when a zero credit balance remains on the gaming machine, or when the player removes a player loyalty card from the gaming machine. After the gaming session ends, the gaming system ends the connection between the gaming system and the portable electronic device (step 611). The gaming system ends the current game play session and enables game play from another player and method 600 ends.

The above systems and methods may be adapted to provide multiplayer gaming through a single gaming machine (e.g., gaming machine 102). For example, gaming machine 102 may be configured to provide a video poker game where multiple players can play against each other. Each player may connect an associated portable electronic device to the gaming system. Display 122 can display community cards heads up (e.g., with the suits and values revealed) and individual player cards in a hidden manner (e.g., with the suits and values hidden). Each player's individual cards are then revealed on the player's associated portable electronic device. Accordingly, each player can shield his cards from opponent players. The player may also provide input to the gaming machine through the portable electronic device (e.g., bet amounts, poker commands, etc.).

The above systems and methods may be adapted to provide a bonus game. The bonus game can incorporate hidden elements in the manner described above. For example, the bonus game may require a player to use a connected portable electronic device as an augmented reality device to locate hidden features such as bonus credits, comps, multipliers, etc.

The above systems and methods may also be adapted to provide game play where indications that hidden elements exist are not displayed through the main display of the electronic gaming machines (e.g., display 122). For example, as discussed above a gaming machine may be configured to provide play of a video poker game. The video poker game is normally a 5-card version of poker. However, when a player connects a portable electronic device to the gaming machine, the player can view two additional cards through a display of the portable electronic device such that the player can then play a 5-card poker game. As an additional example, a gaming machine may offer a video slot game for play. The video slot game normally operates with five video slot reels. However, when a player connects a portable electronic device to the gaming machine, the player can view a sixth video slot reel on a display of the portable electronic device, wherein the sixth reel is not normally visible. In yet another illustrative example, a player may be playing an adventure game on a gaming machine in which the player navigates a character through a course. The course may include traps or hidden awards (e.g., land mines, holes, hidden money, etc.) that are not visible unless the player connects a portable electronic device to the gaming machine.

The above systems and methods may be adapted to encourage non-players of the gaming machines. For example, the gaming machine may be configured to display hidden elements relating to the gaming machine prior to a player initiating a gaming session on the gaming machine. Accordingly, a patron of a casino may connect a portable electronic device to a gaming machine or gaming server prior to playing a game. The display of the portable electronic device may reveal the contents of the hidden elements. The contents of the hidden elements may relate to gaming statistics of the particular gaming machine (e.g., last time a jackpot was hit, number of plays, longest winning streak, etc.), promotional information, casino information, hints and tips for playing the gaming machine, gaming machine rules, and/or any other additional information.

As mentioned above with respect to FIG. 5, the gaming machines (e.g., gaming machine 102) and/or gaming servers (e.g., gaming server 160) handle the random number generation and pay table calculations. Although many portable electronic devices are capable of handling the random number generations and pay table calculations, portable electronic devices are more susceptible to tampering and reprogramming because they are typically owned by the players (e.g., the player's cell phone) and not the casinos. Accordingly, to maintain compliance with gambling regulations in the various gambling jurisdictions, the portable electronic devices coupled to the gaming machines and gaming servers display gaming information received from regulated gaming machines and gaming servers. In some arrangements where the gaming establishment (e.g., a casino) owns and maintains control of the portable electronic devices, the portable electronic devices may be tasked with at least a portion of the random number generation and pay table calculations necessary to offer game play of the wager-based games.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal, e.g., a machine-generated electrical, optical, or electromagnetic signal, that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

It should further be noted that for purposes of this disclosure, the term "couple" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A gaming machine comprising:

a cabinet;

a display device coupled to the cabinet;

a plurality of user input mechanisms coupled to the cabinet, said plurality of user input mechanisms including:

(i) an acceptor, and (ii) a cashout device;

an interface coupled to the cabinet; and a game controller coupled to the cabinet, wherein the game controller is configured to:

(a) if a physical item is received via the acceptor, establish a credit balance based, at least in part, on a monetary value associated with the received physical item;

(b) in association with a play of a wager-based slot game:

(i) cause the display device to display at least a portion of gaming information to a player, wherein:

(A) a wager placed on said play of the wager-based slot game causes a decrease of the credit balance, (B) the gaming information includes a hidden game element including a hidden slot reel which is not displayed to the player via the display device such that the player cannot view the hidden game element via the display device, and (C) any award for the play of the wager-based slot game is determined, at least in part, based on the hidden game element, (ii) facilitate, through the interface, a data connection between the gaming machine and a portable electronic device controlled by the player, and (iii) wirelessly communicate data associated with the hidden game element to the portable electronic device, wherein the data associated with the hidden game element includes an image file for display on a display device of the portable electronic device; and (c) if a cashout input is received via the cashout device, cause an initiation of any payout associated with the credit balance.

2. The gaming machine of claim 1, wherein the game controller is configured to cause the display device to display an instruction to the player to download an application to the portable electronic device.

3. A method of operating a gaming system, the method comprising:

(a) causing a game controller to determine gaming information in association with a play of a wager-based slot game, said determined gaming information including a hidden game element including a hidden slot reel, wherein:

(i) a wager placed on said play of the wager-based slot game causes a decrease of a credit balance which is:

(A) increasable via an acceptor of a physical item associated with a monetary value, and (B) decreasable via a cashout device, and (ii) any award for the play of the wager-based slot game is determined, at least in part, based on the hidden game element;

(b) causing a display device of a gaming machine to display at least a portion of the determined gaming information to a player, wherein the hidden game element is not displayed to the player via the display device of the gaming machine such that the player of the gaming machine cannot view the hidden game element on the display device of the gaming machine;

(c) facilitating, via a gaming machine interface, a data connection between the gaming machine and a portable electronic device; and (d) wirelessly communicating game data associated with the hidden game element to the portable electronic device, wherein the data associated with the hidden game element includes an image file for display on a display device of the portable electronic device.

4. The method of claim 3, which includes determining whether the portable electronic device has an installed application prior to facilitating the data connection.

5. The method of claim 4, which includes causing the display device of the gaming machine to display an instruction to the player to install the application on the portable electronic device if the portable electronic device does not have the installed application.

6. The method of claim 5, wherein the displayed instruction includes a machine readable code.

7. The method of claim 3, which includes causing the game controller to determine that the data connection has been unexpectedly terminated.

8. The method of claim 7, which includes displaying the hidden game element on the display device of the gaming machine in response to determining that the data connection has been unexpectedly terminated.

9. The method of claim 7, which includes displaying a message to the player through the display device of the gaming machine in response to determining that the data connection has been unexpectedly terminated, wherein the message indicates to the player that the portable electronic device has been disconnected from the gaming machine.

10. The method of claim 3, wherein the gaming information includes a plurality of hidden game elements.

11. The method of claim 10, which includes determining a loyalty account status of the player, and wherein a number of hidden game elements revealed to the player through the portable electronic device depends on the determined loyalty account status of the player.

12. The non-transitory computer readable media of claim 10, wherein the instructions cause the processor to determine a loyalty account status of the player, and a number of hidden game elements revealed to the player through the portable electronic device depends on the loyalty account status of the player.

13. A non-transitory computer readable media with computer-executable instructions embodied thereon that, when executed by a processor, cause the processor to:

(a) in association with a play of a wager-based slot game on a gaming machine, determine gaming information including a hidden game element including a hidden slot reel, wherein:

(i) a wager placed on said play of the wager-based slot game causes a decrease of a credit balance which is:

(A) increasable via an acceptor of a physical item associated with a monetary value, and (B) decreasable via a cashout device, and (ii) any award for the play of the wager-based slot game is determined, at least in part, based on the hidden game element;

(b) cause a display device of the gaming machine to display at least a portion of the determined gaming information to a player, wherein the hidden game element is not displayed via the display device of the gaming machine such that the player of the gaming machine cannot view the hidden game element;

(c) facilitate, via a gaming machine interface, a data connection between the gaming machine and a portable electronic device; and (d) wirelessly communicate game data associated with the hidden game element to the portable electronic device, wherein the data associated with the hidden game element includes an image file for display on a display device of the portable electronic device.

14. The non-transitory computer readable media of claim 13, wherein the instructions cause the processor to determine whether the portable electronic device has an installed application prior to facilitating the data connection.

15. The non-transitory computer readable media of claim 14, wherein the instructions cause the processor to cause the display device of the gaming machine to display an instruction to the player to install the application on the portable electronic device.

16. The non-transitory computer readable media of claim 13, wherein the instructions cause the processor to determine that the data connection has been unexpectedly terminated.

17. The non-transitory computer readable media of claim 16, wherein the instructions cause the processor to cause the display device of the gaming machine to display the hidden game element on the display device of the gaming machine in response to determining that the data connection has been unexpectedly terminated.

18. The non-transitory computer readable media of claim 16, wherein the instructions cause the processor to cause the display device of the gaming machine to display a message to the player in response to determining that the data connection has been unexpectedly terminated, wherein the message indicates to the player that the portable electronic device has been disconnected from the gaming machine.

* * * * *